US012577477B2

(12) United States Patent
Biswas et al.

(10) Patent No.: US 12,577,477 B2
(45) Date of Patent: Mar. 17, 2026

(54) PROCESS AND SYSTEM FOR UPGRADING HYDROCRACKER UNCONVERTED HEAVY OIL

(71) Applicant: Chevron U.S.A. Inc., San Ramon, CA (US)

(72) Inventors: Goutam Biswas, Danville, CA (US); Arun Arora, Edison, NJ (US); Bruce Edward Reynolds, Martinez, CA (US); Julie Elaine Chabot, Novato, CA (US); Michael McMullin, Sonoma, CA (US); ShuWu Yang, Richmond, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/766,186

(22) PCT Filed: Nov. 21, 2018

(86) PCT No.: PCT/US2018/062350
§ 371 (c)(1),
(2) Date: May 21, 2020

(87) PCT Pub. No.: WO2019/104243
PCT Pub. Date: May 31, 2019

(65) Prior Publication Data

US 2020/0362253 A1 Nov. 19, 2020

Related U.S. Application Data

(60) Provisional application No. 62/588,924, filed on Nov. 21, 2017.

(51) Int. Cl.

| | |
|---|---|
| ***C10G 67/02*** | (2006.01) |
| ***C10G 31/09*** | (2006.01) |
| ***C10G 49/12*** | (2006.01) |

(52) U.S. Cl.
CPC ..... *C10G 67/02* (2013.01); *C10G 31/09* (2013.01); *C10G 49/12* (2013.01); *C10G 2300/107* (2013.01); *C10G 2300/1077* (2013.01); *C10G 2300/1096* (2013.01); *C10G 2300/202* (2013.01); *C10G 2300/205* (2013.01); *C10G 2300/308* (2013.01); *C10G 2400/06* (2013.01)

(58) Field of Classification Search
CPC .. C10G 31/09; C10G 49/12; C10G 65/10–12; C10G 67/02
See application file for complete search history.

(56) References Cited

U.S. PATENT DOCUMENTS 8,080,155 B2 * 12/2011 Da Costa ..... C10G 31/09 208/177
2014/0299515 A1 * 10/2014 Weiss ..... C10C 3/023 208/390

* cited by examiner

*Primary Examiner* — Renee Robinson
(74) *Attorney, Agent, or Firm* — Mark Warzel

(57) ABSTRACT

Processes and systems for upgrading hydrocracker unconverted heavy oil are provided. The invention is useful in upgrading unconverted heavy oil such as resid derived from hydrocracking processes and may be used to upgrade such resids to form fuel oils such as low sulfur fuel oil for marine use. A combination of solutions is applied in the invention including applying a separation process for unconverted heavy oil comprising hydrocracker resid, combining an aromatic feed with the unconverted heavy oil, followed by subjecting the unconverted heavy oil to a hydrotreating process.

15 Claims, 7 Drawing Sheets

PROCESS AND SYSTEM FOR UPGRADING HYDROCRACKER UNCONVERTED HEAVY OIL

CROSS-REFERENCE TO RELATED APPLICATIONS

This application is related to, and claims priority benefit from, U.S. Provisional Application Ser. No. 62/588,924, filed Nov. 21, 2017, entitled "VR HYDROCRACKER UNCONVERTED OIL UPGRADING PROCESS", and to PCT Application No. PCT/US2018/062350, filed Nov. 21, 2018, both herein incorporated by reference in their entirety.

FIELD OF THE INVENTION

The invention concerns processes and systems for upgrading hydrocracker unconverted heavy oil. The invention is useful in upgrading unconverted heavy oil such as resid derived from hydrocracking processes and may be used to upgrade such resids to form fuel oils such as low sulfur fuel oil for marine use.

BACKGROUND OF THE INVENTION

Petroleum refiners worldwide are confronted with many challenges including deteriorating crude oil quality, stringent product specifications, and varying market demand for various refined products. Crude oils available to refiners have become heavier and dirtier, producing increasing amounts of heavier oil fractions and residues having limited use and lower value. Higher value products such as transportation fuels are increasingly in greater demand. At the same time, emissions and other specifications for transportation fuels, such as gasoline and diesel, have become increasingly stringent. The oil industry is consequently under increasing pressure to convert process residues to, and increase production capacity for, light and middle distillates, while also improving product quality.

Various conversion processes for converting low-value residues to more valuable transportation fuels, including carbon rejection and hydrogen addition, are available for residual oil conversion and upgrading. The hydrogen addition route has the advantage over the carbon rejection route with respect to the quality of distillate products. The distillates produced by hydroconversion processes have lower sulfur, nitrogen, aromatics, and other contaminant levels, as well as better stability and can meet the stringent specifications imposed by environmental regulations. Deep conversion of heavy petroleum oils and residues to lighter cuts by hydroconversion has become increasingly important.

Residuum hydrocracking is a high pressure, high temperature hydroconversion process, which uses ebullated beds (EB) of catalyst to upgrade lower value heavy oils into higher value products, via thermal cracking in presence of hydrogen. EB residuum hydrocracking units can process a heavier feed than fixed bed, gasoil hydrocracking units. Residuum hydrocracker units, such as LC-FINING, are particularly useful to provide increased production or high-quality diesel and kerosene, with reduced residual fuel oil production. EB units also yield heavier products, such as vacuum gas oil (VGO), that can be further processed and upgraded into other products through FCC or hydrocracking. Residuum hydrocracking units typically convert between 60-80% of the vacuum residuum range material processed, producing between 20-40% of vacuum residuum range (vacuum tower bottoms, VTB) unconverted oil (UCO)

product. The onset of sludge or sediment formation typically limits residuum conversion. UCO residuum contains organic solids and hydrocracking catalyst fines, is prohibitively high in viscosity, has a high propensity to flocculate and form a (semi-solid) slurry, is extremely prone to foul process equipment, and is virtually impossible to further process. UCO residuum is therefore typically considered to be of low value and is sent to a coker (a unit operation designed to handle slurries) or blended into (bunker) fuel oil, without further processing or upgrading.

Due to the aforementioned characteristics of UCO residuum, as well as the retention within the UCO residuum of sulfur species that are most resistant to hydroprocessing, i.e., those species that have survived prior severe hydroprocessing, the search for suitable hydroprocessing methods to upgrade UCO residuum for use in other products has heretofore remained unresolved.

Regulatory directives are also providing incentives for new solutions in the development of new hydroprocessing systems and processes. In particular, new IMO bunker fuel oil sulfur specifications lowering the maximum allowable sulfur level to 0.50% m/m (from 3.5%) for fuel oil used on board ships operating outside designated control areas are scheduled to be implemented beginning Jan. 1, 2020 (ISO 8217 and Annex VI of the MARPOL convention of the International Maritime Organization). Such low sulfur tolerance limits severely restrict or eliminate the option of blending high-sulfur components, such as unconverted residuum containing between about 0.75 to 2.5 wt. % sulfur into fuel oil. As a result, alternative means for meeting the 2020 IMO fuel oil specifications, particularly bunker fuel oil sulfur content limits, are necessary.

Another very restrictive regulatory recommendation is the sediment content after ageing according to ISO 10307-2 (also known as IP390), which must be less than or equal to 0.1%. The sediment content according to ISO 10307-1 (also known as IP375) is different from the sediment content after ageing according to ISO 10307-2 (also known as IP390). The sediment content after ageing according to ISO 10307-2 is a much more restrictive specification and corresponds to the specification that applies to bunker oils.

In light of the foregoing, new solutions to the problems associated with upgrading unconverted heavy oil (UCO residuum), and in meeting governing fuel oil specifications, such as the IMO 2020 sulfur content limits, are needed.

Additional background information related to this invention is provided in the publications and patents identified herein. Where permitted, each of these publications and patents is incorporated herein by reference in its entirety.

SUMMARY OF THE INVENTION

The present invention addresses the aforementioned problems through an innovative combination of solutions, thereby allowing UCO residuum to be further processed in a heavy oil hydrotreater. The inventive solution further allows UCO residuum to be used in a fuel oil in accordance with IMO 2020 regulations. Innovative process options for integrating a residuum hydrocracker and a UCO residuum heavy oil hydrotreater are also provided.

In brief, the present invention is directed to a process for upgrading unconverted heavy oil in a hydroprocessing system, a process for making a low sulfur fuel oil from unconverted heavy oil, a process for upgrading a hydroprocessing system, a process for stabilizing an unconverted heavy oil, and a process for hydrotreating an unconverted heavy oil. Hydroprocessing systems for use with these processes are also provided by the invention.

The inventive processes and systems are concerned with the processing of an unconverted heavy oil feed that contains a hydrocracker resid, i.e., wherein the unconverted heavy oil has passed through a hydroprocessing system comprising hydrocracking. The unconverted heavy oil (UCO) or residuum is that portion of the feed to the hydroprocessing system that has passed through the system and remains unconverted in the form of a hydrocracker resid (or residuum). The hydrocracker resid may be derived, for example, from an ebullated bed (EB) reactor as an EB bottoms product or may be an atmospheric or vacuum tower bottoms (ATB or VTB) product where such columns are located downstream from an EB process.

In the inventive upgrading and low sulfur fuel oil processes and systems, the unconverted heavy oil feed comprising hydrocracker resid (or a mixture of the UCO feed combined with an aromatics feed) is passed directly to a separation process, or more particularly a filtration process, to remove insolubles, thereby forming an unconverted heavy oil stream. An aromatics feed is then combined with the unconverted heavy oil (UCO) feed to form a mixture, such that at least one aromatics feed is combined with the UCO feed before or after the separation process step (or more particularly, a filtration process step). The unconverted heavy oil stream (i.e., the mixture of the UCO feed and aromatics feed) is then passed to a heavy oil hydrotreating process, thereby forming a hydrotreated heavy oil stream from the unconverted heavy oil stream. The hydrotreated unconverted heavy oil stream is then further subjected to a recovery process to obtain a product and/or to further treatment or processing.

The inventive process and system for stabilizing an unconverted heavy oil is generally concerned with low solids content UCO feeds comprising hydrocracker resid and having less than about 0.5 wt. % solids. The UCO feed is passed to a filtration process to remove insoluble and is optionally combined with an aromatics feed before being filtered. An unconverted heavy oil stream is recovered in which the UCO heavy oil is stabilized and suitable for further processing.

In the inventive process and system for hydrotreating an unconverted heavy oil comprising hydrocracker resid, the unconverted heavy oil feed (or mixture of the UCO feed combined with an aromatics feed) is passed directly to a hydrotreating process. A hydrotreated heavy oil stream is formed from the unconverted heavy oil feed that is recovered or further treated.

The inventors have surprisingly found that the foregoing processes and related systems make it possible to process UCO residuum—by the combination of blending with an aromatic feed, separation of insolubles, and hydrotreatment—to obtain an unconverted residuum after such treatment that is upgraded and suitable for use in, e.g., a low sulfur fuel oil.

DETAILED DESCRIPTION

Figure 1:
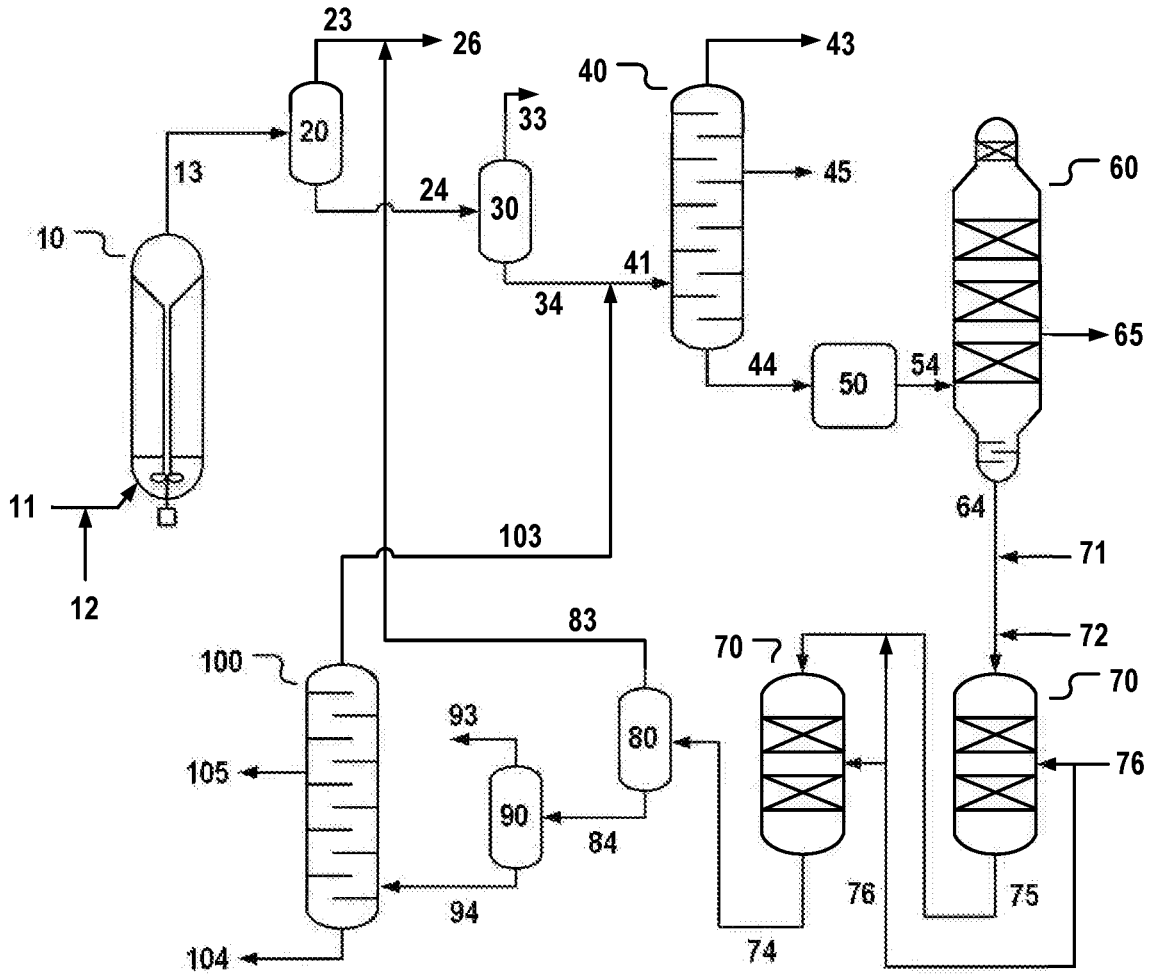
FIGS. 1-7, illustrate non-limiting process configuration aspects and embodiments according to the invention and the claims. The scope of the invention is not limited by these illustrative figures and is to be understood to be defined by the application claims.

In general, the process for upgrading unconverted heavy oil comprises: providing an unconverted heavy oil feed from a hydroprocessing system, wherein the unconverted heavy oil feed comprises hydrocracker resid; optionally, adding a first aromatics feed to the unconverted heavy oil feed to form a mixture; passing the unconverted heavy oil feed or mixture directly to a separation process to remove insolubles, thereby forming an unconverted heavy oil stream; optionally, combining a second aromatics feed with the unconverted heavy oil stream to form a second mixture; passing the unconverted heavy oil stream or second mixture to a heavy oil hydrotreating process, thereby forming a hydrotreated heavy oil stream from the unconverted heavy oil stream or the second mixture; wherein at least one of the first or the second aromatics feeds is combined with the unconverted heavy oil feed or the unconverted heavy oil stream; and, optionally, recovering or further treating the hydrotreated heavy oil stream.

The inventive process for making a low sulfur fuel oil from unconverted heavy oil, comprises: providing an unconverted heavy oil feed from a hydroprocessing system, wherein the unconverted heavy oil feed comprises hydrocracker resid; optionally, adding a first aromatics feed to the unconverted heavy oil feed to form a mixture; passing the unconverted heavy oil feed or mixture directly to a separation process to remove insolubles, thereby forming an unconverted heavy oil stream; optionally, combining a second aromatics feed with the unconverted heavy oil stream to form a second mixture; passing the unconverted heavy oil stream or second mixture to a heavy oil hydrotreating process, thereby forming a hydrotreated heavy oil stream from the unconverted heavy oil stream or the second mixture; wherein at least one of the first or the second aromatics feeds is combined with the unconverted heavy oil feed or the unconverted heavy oil stream; passing the hydrotreated heavy oil stream to a fractionator; and recovering a low sulfur fuel oil product.

The inventive process for upgrading a hydroprocessing system, the process comprises: providing an unconverted heavy oil feed from a hydroprocessing system, wherein the unconverted heavy oil feed comprises hydrocracker resid; optionally, adding a first aromatics feed to the unconverted heavy oil feed to form a mixture; passing the unconverted heavy oil feed or mixture directly to a separation process to remove insolubles, thereby forming an unconverted heavy oil stream; optionally, combining a second aromatics feed with the unconverted heavy oil stream to form a second mixture; passing the unconverted heavy oil stream or second mixture to a heavy oil hydrotreating process, thereby forming a hydrotreated heavy oil stream from the unconverted heavy oil stream or the second mixture; wherein at least one of the first or the second aromatics feeds is combined with the unconverted heavy oil feed or the unconverted heavy oil stream; and, optionally, recovering or further treating the hydrotreated heavy oil stream.

The inventive process for stabilizing an unconverted heavy oil comprising less than about 0.5 wt. % solids comprises: providing an unconverted heavy oil feed from a hydroprocessing system, wherein the unconverted heavy oil feed comprises hydrocracker resid having less than about 0.5 wt. % solids; optionally, adding an aromatics feed to the unconverted heavy oil feed to form a mixture; passing the unconverted heavy oil feed or mixture directly to a filtration process to remove insolubles, thereby forming an unconverted heavy oil stream; and recovering the unconverted heavy oil stream; wherein the unconverted heavy oil stream is stabilized such that it is suitable for further hydroprocessing.

The inventive process for hydrotreating an unconverted heavy oil comprises: providing an unconverted heavy oil feed from a hydroprocessing system, wherein the unconverted heavy oil feed comprises hydrocracker resid; passing the unconverted heavy oil feed to a heavy oil hydrotreating process, thereby forming a hydrotreated heavy oil stream from the unconverted heavy oil feed; and recovering or further treating the hydrotreated heavy oil stream.

The unconverted heavy oil, also referred to herein as UCO, UCO heavy oil, or UCO residuum, used in the processes and systems of the invention include a hydrocracker resid or residuum component. As such, the UCO heavy oil is unconverted oil that has passed through a hydroprocessing system that includes hydrocracking and in which a hydrocracker resid is formed. Typically, such resids are derived from an ebullated bed (EB) reactor process as a bottoms product but may also be derived as a bottoms product from an atmospheric of vacuum column as an ATB or VTB unconverted heavy oil resid. The unconverted heavy oil may be subjected to both hydrocracking and demetallation during hydroprocessing.

The UCO heavy oil used in the processes and systems of the invention is distinguished from heavy oils that may be used as feeds to a hydroprocessing system in that the UCO heavy oil used herein has already been subjected to hydroprocessing. Heavy oil feeds that may be used for the unprocessed feed typically include atmospheric residuum, vacuum residuum, tar from a solvent deasphalting unit, atmospheric gas oil, vacuum gas oil, deasphalted oil, oil derived from tar sands or bitumen, oil derived from coal, heavy crude oil, oil derived from recycled oil wastes and polymers, or a combination thereof. The UCO feed for the processes and systems of the invention may be obtained from these sources after they are subjected to hydroprocessing in a hydroprocessing system that includes hydrocracking and forms hydrocracker resid.

The UCO heavy oil feed used may comprise only hydrocracker resid, e.g., as derived from an EB bottoms product, or may include other suitable feed components combined with the hydrocracker resid. Preferably, the UCO heavy oil feed is predominantly hydrocracker resid, but may also be greater than about 70 vol. %, or greater than about 90 vol. %. More than one hydrocracker resid component may also be include in the UCO heavy oil feed. Suitable additional components for the UCO heavy oil feed include, e.g., heavy oil feeds as noted hereinabove or hydroprocessed forms thereof and other suitable blend components including aromatics feed components described herein.

The aromatics feed combined with the UCO heavy oil feed generally includes a significant aromatics portion, e.g., greater than about 20 vol. % aromatics, or greater than about 30 vol. % aromatics, or greater than about 50 vol. % aromatics, or greater than about 70 vol. % aromatics, or greater than about 90 vol. % aromatics. Suitable aromatics feeds may be selected from light cycle oil (LCO), medium cycle oil (MCO), heavy cycle oil (HCO), decant oil (DCO) or slurry oil, vacuum gas oil (VGO), or a mixture thereof. Aromatic UCO from a hydrocracking process or deasphalt oil (DAO) may also be used.

The aromatic feed may be combined with the UCO heavy oil feed before or after the UCO feed or the UCO feed/aromatic feed mixture is passed to a subsequent separation process, or, more particularly, a filtration process. The aromatic feed may also be combined with the UCO heavy oil feed both before and after the separation (filtration) process step.

The boiling point of an aromatic feed added to the UCO feed is preferably from 250-1300° F., more preferably from 350-1250° F., and most preferably from 500-1200° F. Light aromatic solvents like benzene, toluene, xylene or Hi-Sol are not desired for the aromatics feed. Paraffinic solvents such as hydrotreat diesel and F-T wax are also not suitable for the aromatics feed. The API gravity of the aromatic feed is preferably from −20 to 20 degrees, more preferably from −15 to 15 degrees, and most preferably from −10 to 15 degrees. The aromatic content in the aromatic feed can be measured by component analysis (22×22) or SARA test, and is preferred to be >20%, and more preferably, >30%. The viscosity of the aromatic feed is preferably from 0.2 to 100 cSt at 100° C., and more preferably from 1 to 60 cSt. The amount of aromatic feed is preferred to be 3-20%, more preferably from 5-15%, and most preferably from 5-10%.

The UCO heavy oil feed, whether alone or combined with an aromatic feed prior to being subjected to the separation (filtration) process step, is preferably not subjected to an intermediate step and is passed directly to the separation process, or, more particularly, the filtration process step. In this regard, the description of "passing the unconverted heavy oil feed or mixture directly to a separation process" or "passing the unconverted heavy oil feed or mixture directly to a filtration process" is intended to mean there is no intermediate step involved. In particular, certain intermediate steps such as a maturation or aging process step, or a sedimentation step, are intended to be excluded from the process prior to the separation or filtration of the UCO heavy oil feed or the mixture thereof with the aromatics feed.

The unconverted heavy oil feed, whether alone or combined with the aromatics feed to form mixture, is passed directly to a separation process step, or, more particularly, to a filtration process step. While the separation process is preferably a filtration process, suitable equivalents may be used as substitutes, or in addition to a filtration process step. As noted, however, the use of a maturation, aging, or sedimentation step prior to the separation or filtration process step is not intended.

The separation or filtration process step removes insolubles from the UCO heavy oil stream, including, e.g., catalyst fines, particulates, sediments, agglomerated oil and aggregates. Preferably, the separation process comprises or is a filtration process or step. Suitable filtration processes generally include mesh, screen, cross-flow filtration, backwash filtration, or a combination thereof. Preferred filtration processes include membrane filtration processes, e.g., microfiltration processes, using membranes having an average pore size of less than 10 microns, more particularly, an average pore size of less than 5 microns, or an average pore size of less than 2 microns. While not limited thereto, the filtration membrane may be composed of a material selected from metals, polymeric materials, ceramics, glasses, nanomaterials, or a combination thereof. Suitable metals include stainless steel, titanium, bronze, aluminum, nickel, copper and alloys thereof. Such membranes may also be coated for various reasons, and with various materials, including inorganic metal oxides coatings.

An associated aspect of the invention relates to the use of filtration as a means of stabilizing UCO heavy oil. In this regard, the inventors have surprisingly found that such difficult and unstable hydrocracked resids may be stabilized against sedimentation and other instabilities through the use of a filtration process according to the invention. Aromatic feeds as described herein may also be combined with the UCO heavy oil and subjected to such a filtration process in order to stabilize the UCO heavy oil and render it suitable for further hydroprocessing.

The heavy oil hydrotreating (HOT) process of the invention is used to hydrotreat the unconverted heavy oil feed or a mixture of the UCO heavy oil feed with the aromatics feed. Suitable operating conditions generally include ranges known in the art, e.g., as may be known for residuum desulfurization system (RDS) reactor processing with notable exceptions. For heavy oil hydrotreating (HOT) according to the invention, reactor space velocities are generally lower, e.g., in the range of about 0.06 to 0.25 $hr^{-1}$, whereas space velocities for RDS systems are typically in the range of about 0.15 to 0.40 $hr^{-1}$. Target catalyst lifetimes are also significantly increased for HOT operation, typically being in the range of 2-3 years compared with 6-14 months for RDS systems. Other HOT operating conditions include: reactor pressures of about 2500 psig (2000-3000 psig); an average reactor temperature of 690-770° F.; a hydrogen to oil ratio of 4500-5000 SCFB; a hydrogen consumption of 500-1200 SCFB.

The heavy oil hydrotreater (HOT) unit may comprise an upflow fixed bed reactor, a downflow fixed bed reactor, or a combination thereof. Any of these reactors may a multi-catalyst bed reactor, or multiple single catalyst bed reactors, or a combination thereof.

Certain feed and product specifications are also applicable to the HOT process. For example, the feed to the hydrotreating process generally meets one or more of the following: an API in the range of −5 to 15, a sulfur content in the range of 0.7 to 3.5 wt. %, a microcarbon residue content of 8 to 35 wt. %, or a total content of Ni and V of less than 150 ppm. The hydrotreated heavy oil stream from the hydrotreating process also generally meets one or more of the following: an API in the range of 2 to 18, a sulfur content in the range of 0.05 to 0.70 wt. %, a microcarbon residue content of 3 to 18 wt. %, or a total content of Ni and V of less than 30 ppm. In addition, the HOT process conversion of sulfur is generally in the range of 40-90%, the MCR conversion is generally in the range of 30-70% and the Ni+V metals conversion is generally in the range of 50-95%.

The heavy oil hydrotreating process generally comprises a catalyst selected from a demetallation catalyst, a desulfurization catalyst, or a combination thereof. More particularly, such catalysts may comprise a catalyst composition comprising about 5-20 vol. % of a grading and demetallation catalyst, about 10-30 vol. % of a transition-conversion catalyst, and about 50-80 vol. % of a deep conversion catalyst. More preferred ranges include a catalyst composition comprising about 10-15 vol. % of a grading and demetallation catalyst, about 20 25 vol. % of a transition-conversion catalyst, and about 60-70 vol. % of a deep conversion catalyst. The grading and demetallation catalyst, transition-conversion catalyst, and deep conversion catalyst may be layered in order to sequentially treat the unconverted heavy oil stream.

Suitable catalysts for use as grading and demetallation catalyst, transition-conversion catalysts, and deep conversion catalysts are described in various patents, including, e.g., U.S. Pat. Nos. 5,215,955; 4,066,574; 4,113,661; 4,341,625; 5,089,463; 4,976,848; 5,620,592; and 5,177,047.

The grading catalyst provides enhanced trapping of particulates and highly reactive metals to mitigate fouling and pressure drop, while the demetallation catalyst provides high demetallation activity and metals uptake capacity required to achieve desired run length. The grading and demetallation catalysts are used for metal removal and have low HDS, HDN and HDMCR activity. Such catalysts have high pore volume (typically >0.6 cc/g), large mean mesopore diameter (>180 angstroms), and low surface area (<150 $m_2/g$), as measured by Brunauer-Emmett-Teller (BET) method with $N_2$ physisorption. The active metal level (Mo and Ni) on the grading and demetallation catalysts are on the low side, with Mo typically at <6 wt %, and Ni at <2 wt %.

The transition and conversion catalyst provides moderate demetallation activity and metals uptake capacity, with moderate HDS and MDMCR activity. Transition and conversion catalyst have intermediate pore volume, pore size and active metal content relative to grading and demetallation catalysts and deep conversion catalysts. The catalyst pore volume is typically at 0.5-0.8 cc/g, surface area at 100-180 $m^2/g$, and mean mesopore diameter at 100-200 angstroms, as measured by BET method. The active Mo level is typically at 5-9 wt %, and Ni at 1.5-2.5 wt %.

The deep conversion catalyst converts the least reactive S, N and MCR species to achieve deep catalytic conversion and meet product target. Deep conversion catalysts have low demetallation activity and metals uptake capacity. The deep conversion catalyst has low pore volume, high surface area, small pore size and high metal level. The catalyst pore volume is typically at <0.7 cc/g, surface area at >150 $m^2/g$, and mean mesopore diameter at <150 angstroms, as measured by BET method. The active Mo level is typically at >7.5 wt %, and Ni at >2 wt %.

A diluent may also be added after the hydrotreating process step, if desired. Such diluents may be an aromatic diluent such as LCO or MCO from FCC process, an aromatic solvent such as toluene, xylene or Hi-Sol, or non-aromatic diluent such as jet fuel or diesel. If added, the total amount of diluent added may generally be in the range of 1-50%, more preferably 5-40%, and most preferably 10-30%. The amount of aromatic diluent is preferred to be half or more of all the diluent added (aromatic+non-aromatic). The boiling point of a diluent added to the product to make a low sulfur fuel oil product is preferably from 100 to 1200° F., more preferably from 200 to 1000° F., and most preferably from 300 to 800° F.

The processes of the invention may advantageously be used to make a product for use in a low sulfur fuel oil, particularly one meeting the IMO year 2020 specifications for sulfur content. More particularly, such processes may be used to make products for use in low sulfur fuel oil having a sulfur content of less than 0.5 wt. %, or less than 0.3 wt. %, or less than 0.1 wt. %.

Hydroprocessing system configurations for use with the inventive processes generally comprise the following hydroprocessing units: an integrated heavy oil treater (HOT), a filtration system (FS), a heavy oil stripper (HOS), one or more high pressure high temperature separators (HPHT), one or more medium pressure high temperature separators (MPHT), an atmospheric column fractionator (ACF), optionally, a vacuum column fractionator (VCF), and, optionally, a HOT stripper The hydroprocessing system units are understood to be in fluid communication and fluidly connected for flow through hydroprocessing of a hydrocarbonaceous feedstream. The hydroprocessing system units are arranged according to the following conditions:

- the FS unit is located upstream of the HOT unit and downstream of the HOS unit;
- the HPHT unit is located upstream of the MPHT unit;
- the HOS unit is located upstream of the VCF unit;
- the HOT stripper is located downstream of the HOT unit;

an HPHT unit and an MPHT unit are located upstream of the HOS unit;

an HPHT unit, and optionally an MPHT unit, is located upstream of the HOT unit;

an HPHT unit, and optionally an MPHT unit, is located upstream of the ACF and VCF units; and an ACF unit, and optionally a VCF unit, is located downstream of the HOT unit.

In certain illustrative embodiments, the hydroprocessing system units may be arranged in the following flow through sequence: a HOS unit, which is followed by an FS unit, which is followed by a VCF unit, which is followed by a HOT unit, and which is followed by an ACF unit.

In another illustrative embodiment, the hydroprocessing system units may be arranged in the following flow through sequence: a HOS unit, which is followed by a VCF unit, which is followed by an FS unit, which is followed by a HOT unit, and which is followed by an ACF unit.

In another illustrative embodiment, the hydroprocessing system units may be arranged in the following flow through sequence: a HOS unit, which is followed by an FS unit, which is followed by a HOT unit, and which is followed by an ACF unit.

In another illustrative embodiment, the hydroprocessing system units may be arranged in the following flow through sequence: a HOS unit, which is followed by an FS unit, which is followed by a HOT unit, which is followed by an ACF unit, and which is followed by a VCF unit.

In another illustrative embodiment, the hydroprocessing system units may be arranged in the following flow through sequence: a HOS unit, which is followed by an FS unit, and which is followed by a VCF unit; and a HOT unit, which is followed by an ACF unit, wherein the VCF unit includes a bottom fraction recycle fluid connection to a feedstream connection to the HOT unit.

In another illustrative embodiment, the hydroprocessing system units may be arranged in the following flow through sequence: a HOS unit, which is followed by an FS unit, which is followed by a HOT unit, which is followed by an ACF unit, and which is followed by a VCF unit.

In another illustrative embodiment, the hydroprocessing system units may be arranged in the following flow through sequence: a HOS unit, which is followed by an FS unit, which is followed by a VCF unit, which is followed by a first HOT unit, which is followed by an HPHT unit, and which is followed by a HOT stripper unit, wherein the HOT stripper unit includes an overhead fraction recycle fluid connection to a feedstream connection to the HOS unit; and a second HOT unit, which is followed by an ACF unit; wherein the HPHT unit following the first HOT unit includes an overhead fraction recycle fluid connection to a feedstream connection to the first HOT unit.

Figure 2:
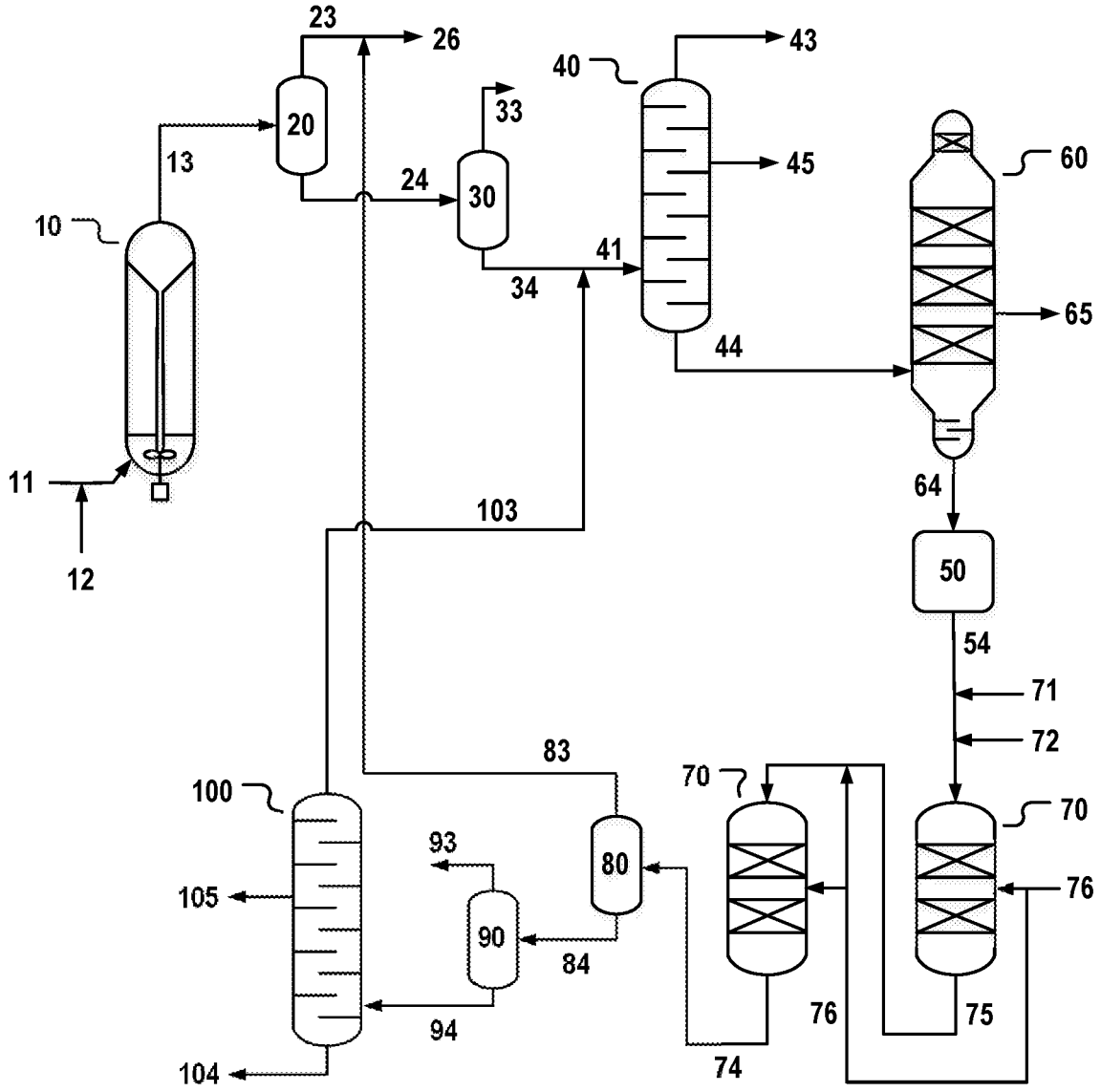
Figure 3:
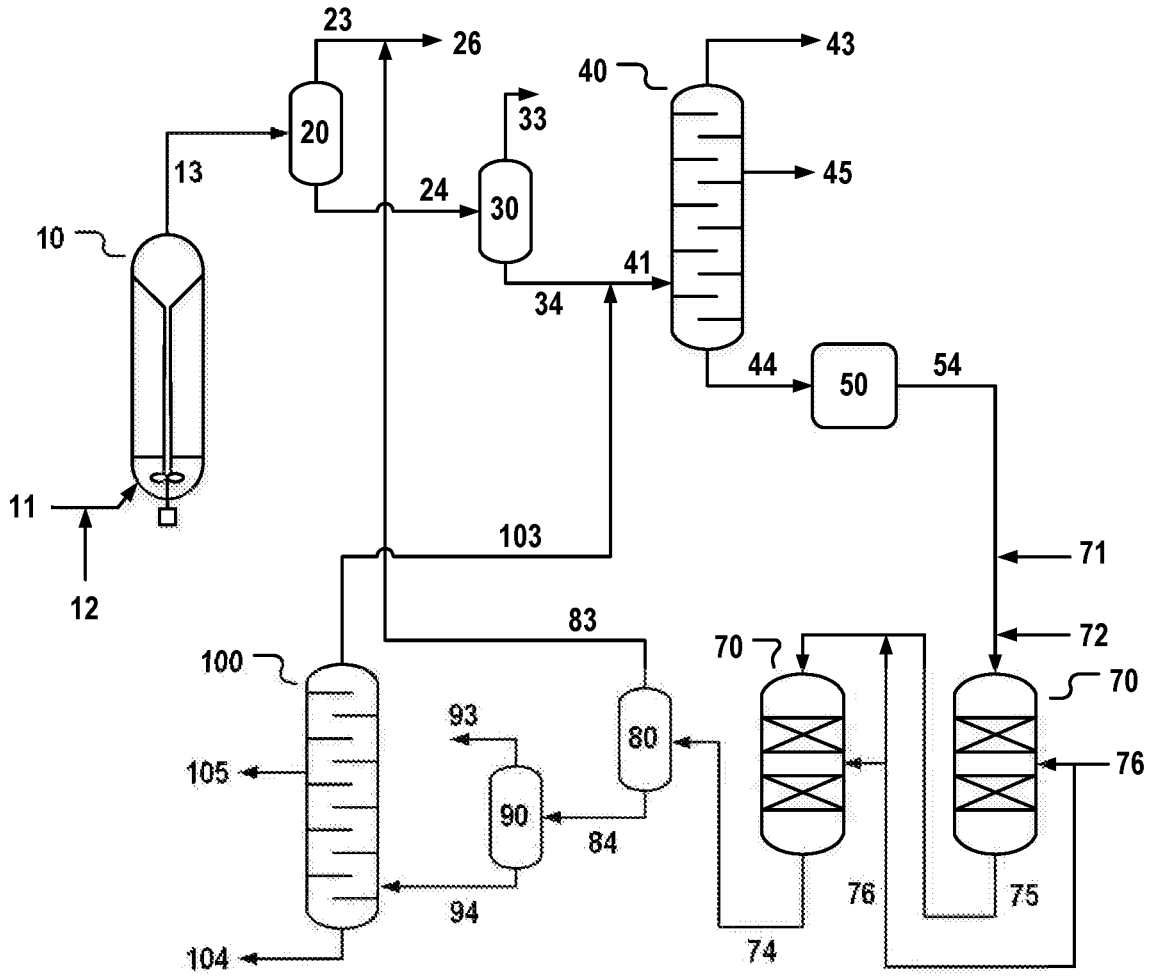
Figure 4:
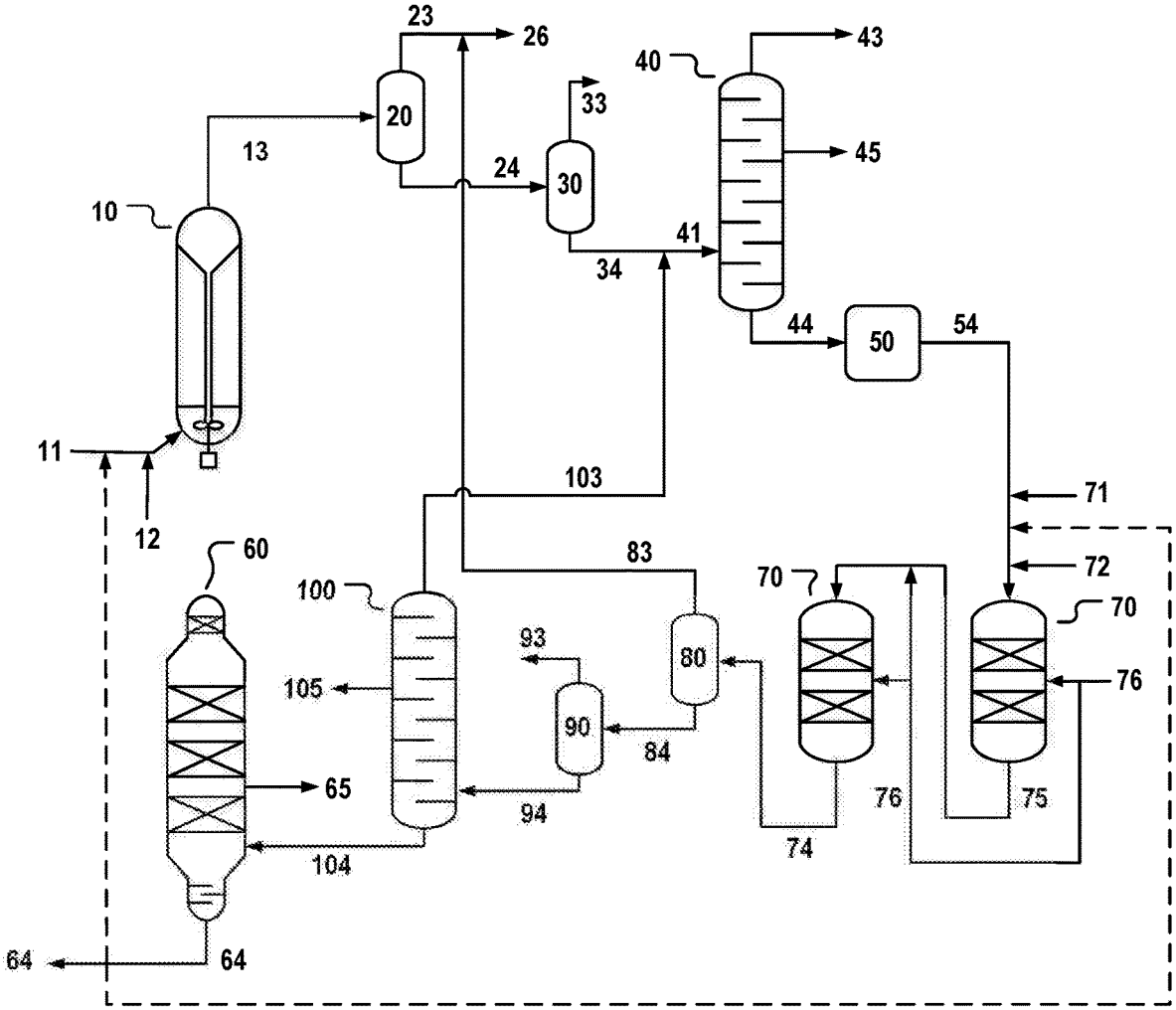
Figure 5:
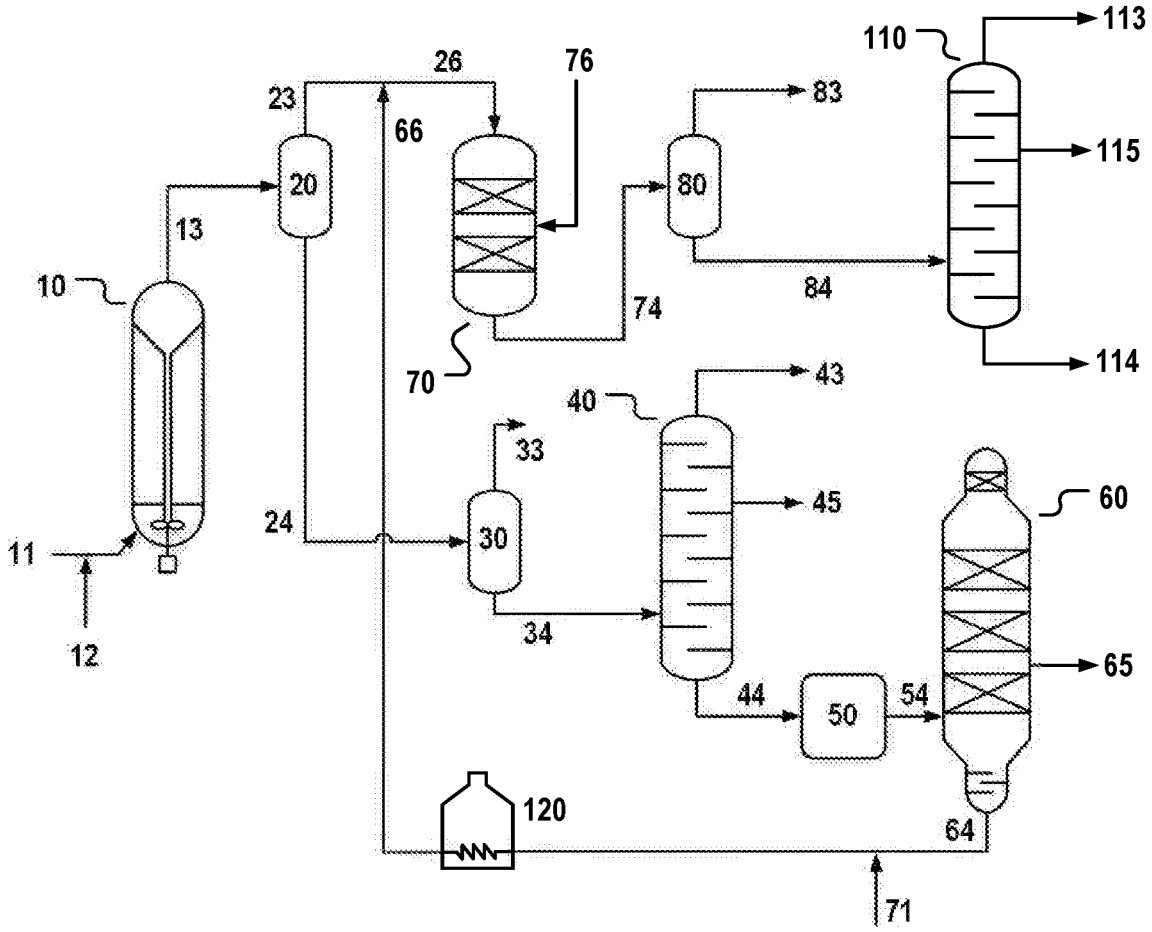
Figure 6:
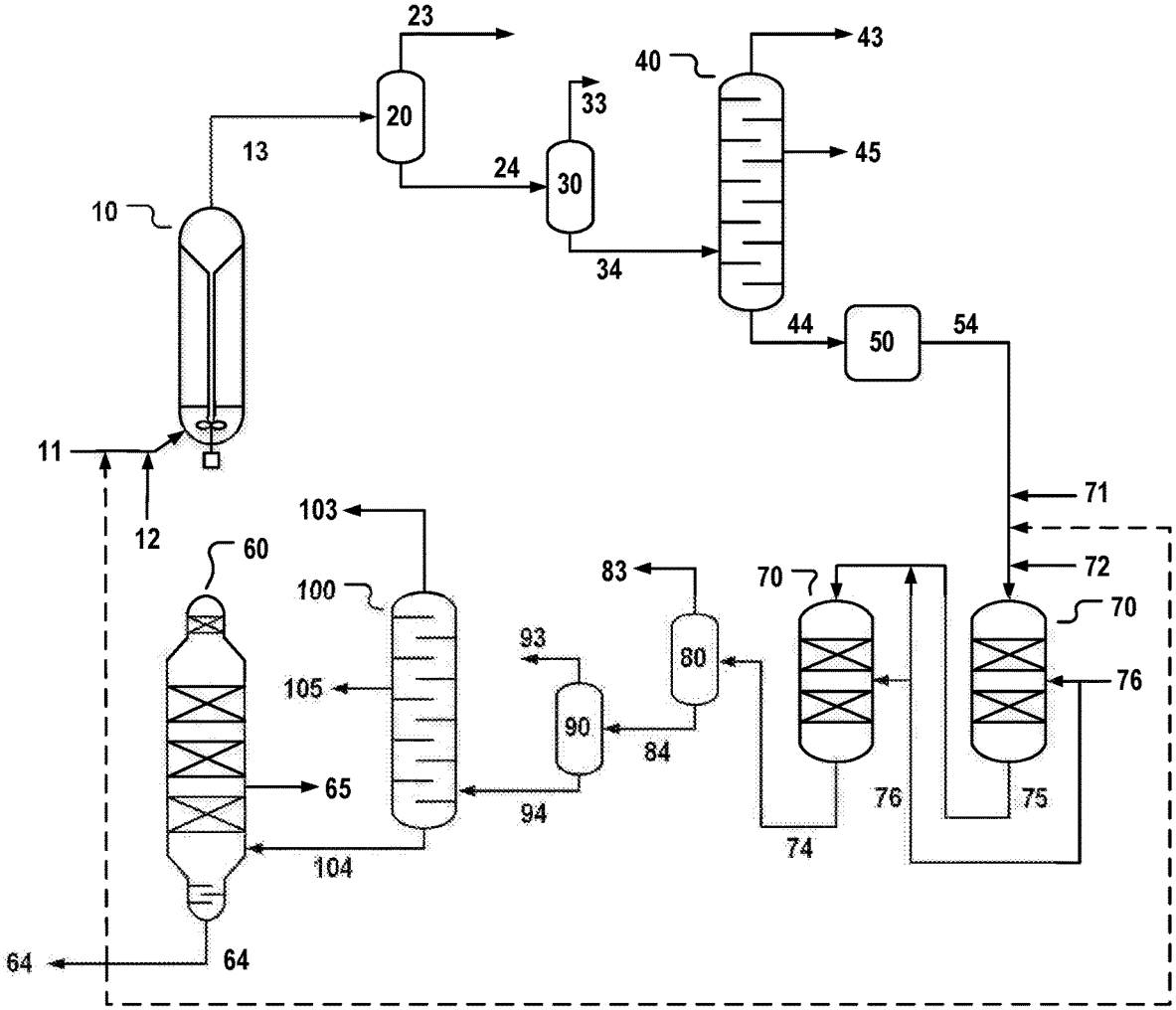
Figure 7:
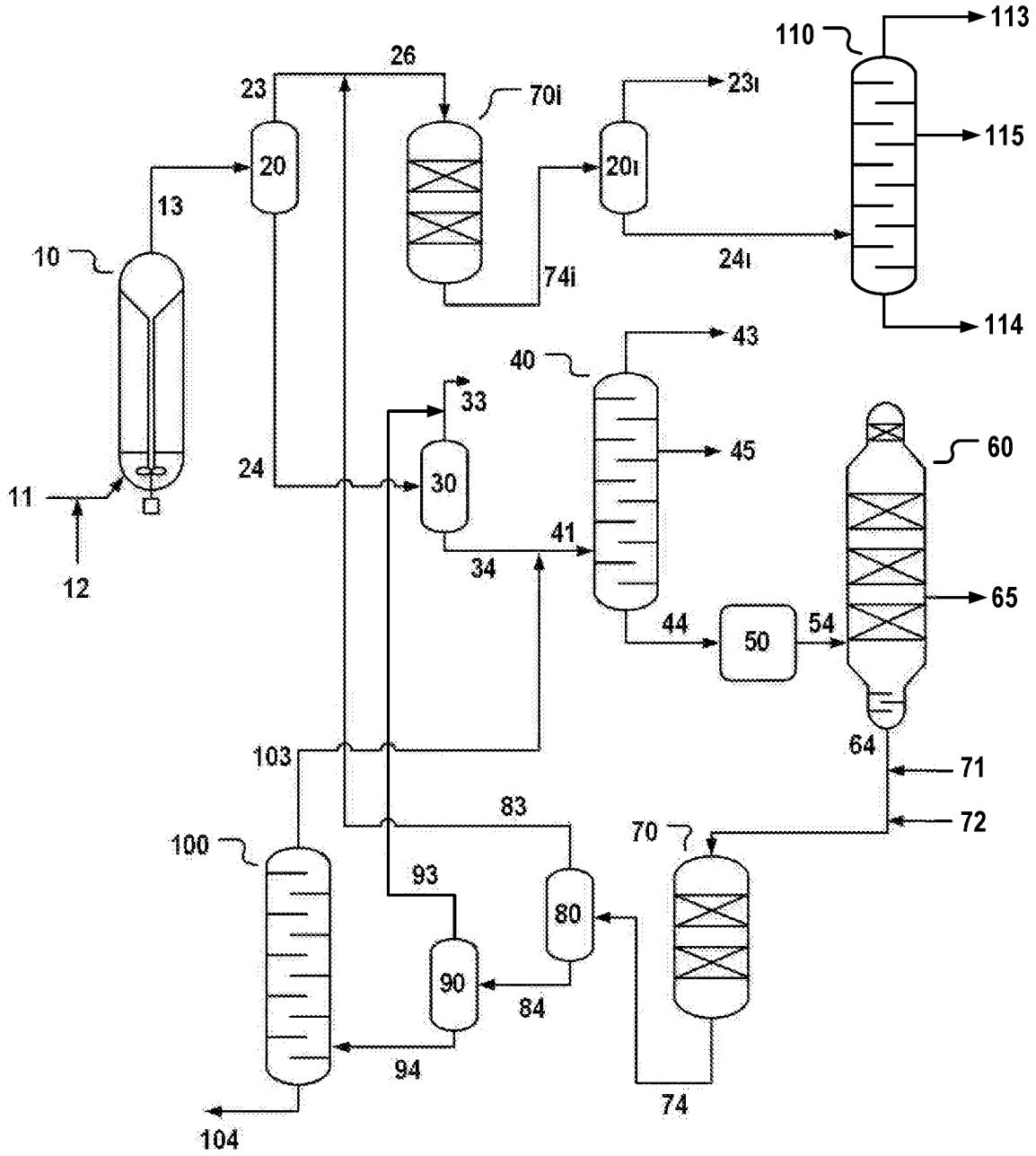

Each of the foregoing illustrative embodiments, is shown in FIGS. 1-7. In each of the figures, particular units and process and product streams are identified as follows:

Process units: ebullated bed reactor (10); high pressure separator, HPHT (20); medium pressure separator, MPHT (30); atmospheric tower or heavy oil stripper, HOS (40); separation process or filter process unit (50); vacuum column (60); HOT hydrotreater (70); HPHT separator (80); MPHT separator (90); fractionators (100) and (110); heater (120).

Process streams: EB reactor feed (11); hydrogen feed (12); additional feed (71); additional hydrogen (72); quench gas or liquid (76).

Process and/or product streams not specifically identified above but enumerated in the illustrative figures are intended to identify normal process and product streams from such units and do not require further detail for the purposes herein. In particular, process and product streams identified in FIGS. 1-7 include streams 13, 23, 23*i*, 24, 24*i*, 26, 34, 33, 41, 43, 44, 45, 54, 64, 65, 71, 72, 74, 74*i*, 75, 76, 83, 84, 93, 94, 103, 104, 105, 113, 114, 115.

Although not specifically shown in these figures, additional aromatic feed according to the inventive process is added either before the separation or filter process unit (50) or after this unit. Additional diluent may also be added as described hereinabove after the HOT hydrotreater (70).

SUPPORTING EXAMPLES

Various supporting studies were undertaken to validate the advantages associated with the invention. Atmospheric tower bottoms (ATB) and vacuum tower bottoms (VTB) products were collected and combined with an aromatic feed component and/or filtered according to the invention to provide the following results.

Examples 1-6: Impact of Aromatic Feed and Filtration on Stability of Unconverted Residuum In unconverted residuum, there are inorganic particulates, such as alumina, silica, iron sulfide, etc., originating from attrited catalysts and organic sediment particles.

As shown in Table 1, freshly harvested unconverted residuum (made from atmospheric tower bottoms or ATB) contains various metals (Example 1). Metals not fond in residuum such as molybdenum are indicative of attrited catalysts. Filtration over a 0.45-micron filter removes the majority of metals such as Ni, V, Al, Fe, Mo, Na and Si (Example 2). The Ni and V left in the permeate are probably part of organic compounds that remain dissolved in the unconverted residuum. A modifier derived from Fluidized Catalytic Cracking (FCC) introduces additional Al, Si from attrited FCC catalysts (Example 3). Filtration also removes these FCC catalyst fines (Example 4).

TABLE 1

Impact of modifier and filtration on stability of unconverted residuum

| | Example # | | | | | |
|---|---|---|---|---|---|---|
| | 1 | 2 | 3 | 4 | 5 | 6 |
| Feed Description | Unconverted ATB | Unconverted ATB | Modifier from FCC | Modifier from FCC | Unconverted ATB | Unconverted ATB |
| Modifier, wt-% | 0 | 0 | 100 | 100 | 10 | 10 |
| Apply Filtration | No | Yes | No | Yes | No | Yes |

TABLE 1-continued

| Impact of modifier and filtration on stability of unconverted residuum | | | | | | |
|---|---|---|---|---|---|---|
| | Example # | | | | | |
| | 1 | 2 | 3 | 4 | 5 | 6 |
| Filter paper pore size, μm | N/A | 0.45 | N/A | 0.45 | N/A | 0.45 |
| Metal Analysis | | | | | | |
| Al, ppm | 41.8 | UDL | 11.1 | 5.1 | 38.7[a] | 5.7 |
| Fe, ppm | 90.3 | UDL | 1.9 | UDL | 81.5[a] | UDL |
| Mo, ppm | 8.9 | UDL | UDL | UDL | 8.0[a] | UDL |
| Na, ppm | 22.8 | UDL | UDL | UDL | 20.5[a] | UDL |
| Ni, ppm | 37.4 | 12.7 | UDL | 4.0 | 33.7[a] | 11.7 |
| Si, ppm | 9.9 | UDL | 8.5 | UDL | 9.8[a] | UDL |
| V, ppm | 56.3 | 12.3 | UDL | UDL | 50.7[a] | 11.7 |
| Sediment Level, ppm | 37621 | 190 | 76 | 15 | 31637 | 145 |

Note:
UDL means Under Detection Limit, which is typically <1 ppm; N/A means not applicable;
[a]Estimated based on the metal analysis of ATB and Modifier.

The sediment level reflects the feed stability. At any stage in the process, an unconverted residuum with high initial sediment tends to sediment further, which causes equipment fouling and plugging issues. Sediment levels are quantified with the Shell Hot Filtration method ASTM D4870. The sediment levels of some unconverted residuums before and after filtration and/or modifier addition are listed in Table 1. Worth noting is that sediment includes both inorganic and organic particulates. Without modifier or filtration, the sediment level in the unconverted residuum is very high, reaching 37621 ppm (Example 1). Modifier addition alone decreased sediment to 31637 ppm (Example 5). Filtration alone (with a 0.45-micron filter) decreased sediment to 190 ppm (Example 2), suggesting filtration effectively removed inorganic solids (confirmed by metal analysis) and large organic solids. Modifier addition followed by filtration decreased sediment level most to 145 ppm by (Example 6).

Examples 7-12: Filtration Effectiveness in Reducing Sediment in Unconverted Residuum Table 2 demonstrates the effectiveness of filtration in removing inorganic particles (attrited catalysts) from unconverted residuum stemming from VTB. These attrited and used de-metallization catalysts are detectable as 43.8 ppm of Al, 19.5 ppm of Si, 7.3 ppm of Mo and 94.5 ppm Fe (Example 7). Filtration (with a 0.45-micron filter) removes most metals such as Ni, V, Al, Fe, Mo, Na and Si (Example 8). The remaining 24.3 ppm of Ni and 19.7 ppm of V are presumably in soluble organic form.

The effect of filter size was also investigated (Examples 9-12). Metal analysis indicated a filter pore size of 0.45-20 micron suffices to remove the majority of attrited catalysts.

TABLE 2

| Effectiveness of filtration in reducing inorganic sediment in unconverted residuum | | | | | | |
|---|---|---|---|---|---|---|
| | Example # | | | | | |
| | 7 | 8 | 9 | 10 | 11 | 12 |
| Unconverted residuum source | VTB | VTB | VTB | VTB | VTB | VTB |
| Modifier, wt-% | 0 | 0 | 10 | 10 | 10 | 10 |
| Apply Filtration | No | Yes | Yes | Yes | Yes | Yes |

TABLE 2-continued

| Effectiveness of filtration in reducing inorganic sediment in unconverted residuum | | | | | | |
|---|---|---|---|---|---|---|
| | Example # | | | | | |
| | 7 | 8 | 9 | 10 | 11 | 12 |
| Filter paper size, micron | N/A | 0.45 | 0.45 | 5 | 10 | 20 |
| Metal Analysis | | | | | | |
| Al, ppm | 43.8 | 3.3 | UDL | UDL | 4.0 | UDL |
| Fe, ppm | 94.5 | UDL | UDL | UDL | UDL | UDL |
| Mo, ppm | 7.3 | UDL | UDL | UDL | UDL | UDL |
| Na, ppm | 18.8 | UDL | UDL | UDL | UDL | UDL |
| Ni, ppm | 42.9 | 24.3 | 20.7 | 16.5 | 16.9 | 17.0 |
| Si, ppm | 19.5 | UDL | UDL | UDL | UDL | UDL |
| V, ppm | 80.4 | 19.7 | 17.5 | 13.6 | 13.9 | 14.2 |

Note:
UDL means Under Detection Limit, which is typically <1 ppm; N/A means not applicable.

Examples 13-16: Impact of Modifier on Mobility of Unconverted Residuum

Table 3 lists the viscosity of Resid Hydrocracking UCO feeds to hydrotreater before and after modifier addition. Five wt-% modifier reduces the viscosity of an ATB-derived unconverted residuum from 61.4 cSt at 100° C. to 58.4 cSt (Examples 13 and 14). Ten wt-% modifier reduces the viscosity of a VTB derived unconverted residuum from 347.6 cSt at 100° C. by 31% to 240.9 cSt at 100° C. (Examples 15 and 16). Clearly, modifiers both improve stability (wt-% sediment) and viscosity, which greatly improves the easy of handling for unconverted residua.

TABLE 3

| Effect of aromatic diluent addition on the viscosity of unconverted residuum | | | |
|---|---|---|---|
| Example # | Unconverted Residuum Source | Modifier, wt-% | Viscosity of the feed at 100° C., cSt |
| 13 | ATB | 0 | 61.4 |
| 14 | ATB | 5 | 58.4 |
| 15 | VTB | 0 | 347.6 |
| 16 | VTB | 10 | 240.9 |

Examples 17-19: Impact of Modifier and Filtration on Stability of Hydrotreated Unconverted Residuum Table 4 compares the effect of modifier addition on the stability of unconverted residuum after filtration and hydrotreating, as measured by sediment with Shell Hot Filtration method ASTM D4870. Low sediment level in an oil product indicates good stability. If the unconverted residuum was not filtered and if no modifier was added, the sediment level in the final hydrotreated product was 1210 ppm, indicative of an unstable product that easily sediments, and that readily causes operational issues (Example 17). If the unconverted residuum was only filtered (no modifier added), the sediment level in the product decreased to 156 ppm, indicative of intermediate sedimentation propensity (Example 18). Only a combination of modifier addition and filtration brings the sediment level in the hydrotreated product to an acceptable 31 ppm (Example 19).

TABLE 4

Impact of modifier and filtration on stability of unconverted residuum

| Example # | Source of filtered UCR | Filtered | Modifier added | Sediment level in Product, ppm |
|---|---|---|---|---|
| 17 | VTB | No | 0 wt-% | 1210 |
| 18 | VTB | Yes | 0 wt-% | 156 |
| 19 | VTB | Yes | 10 wt-% | 31 |

Examples 20-22: Impact of Aromatic Feed and Filtration on Hydrotreating Feasibility Table 5 highlights the importance of aromatic feed component addition and feed filtration on the feasibility of hydrotreating the unconverted residuum. Without both an aromatic feed component and filtration, the pressure drop across the fixed bed hydrotreater grew at a prohibitively high rate, effectively precluding operation for the time needed (typically at least half a year) to have an economical process.

TABLE 5

Impact of modifier and filtration on hydrotreating feasibility

| Example # | Feed Description | Filtered | Modifier | Daily increase in pressure across reactor |
|---|---|---|---|---|
| 20 | VTB | No | 0 wt-% | 5-15 psig |
| 21 | VTB | Yes | 0 wt-% | 5-15 psig |
| 22 | VTB | Yes | 10 wt-% | 0 psig |

Examples 23-25: Illustrations of Efficacy of Overall Process

Tables 6-8 illustrate the efficacy of the combination of modifier addition, filtration and hydrotreating to convert unconverted residuum into low sulfur fuel oil (LSFO).

Table 6 (example 23) and 7 (example 24) illustrate LSFO production from unconverted residuum of VTB and ATB pedigree, respectively. Both cases result in significant volume swell (API gains) and contaminates reduction. Both products meet the 0.5 wt % sulfur limit set in IMO 2020 regulation.

Table 8 (example 25) illustrates how the hydrotreater increases the conversion of originally unconverted vacuum residuum, yielding nearly 12 wt-% additional C2-900° F. The hydrotreater also increases overall sulfur conversion from 80% to 90%, and improves N, MCR, asphaltene, V and Ni conversion.

TABLE 6

Upgrading of unconverted residuum with VTB pedigree into LSFO

| Example 23 | Feed: LC-FINING UCO - VTB, Filtered with 10% Modifier | Whole-Liquid Product |
|---|---|---|
| API | 8.4 | 12.9 |
| Density, g/ml | 1.01 | 0.98 |
| S, wt % | 1.34 | 0.47 |
| N, ppm | 5500 | 4161 |
| MCR, wt % | 18.83 | 11.88 |
| Asphaltenes, wt % | 8.85 | 2.99 |
| C, wt % | 88.16 | 88.44 |
| H, wt % | 10.34 | 10.91 |
| H/C, wt/wt | 0.117 | 0.123 |
| V, ppm | 17.6 | 0.5 |
| Ni, ppm | 21.8 | 9.2 |
| 1000° F.+ (538° C.+) | 74.0 | 64.7 |
| 800° F.+ (427° C.+) | 94.2 | 88.5 |
| 680° F.+ (360° C.+) | 98.2 | 94.6 |

TABLE 7

Upgrading of unconverted residuum of ATB pedigree into LSFO

| Example 24 | Feed (LC-FINING UCO - ATB, Filtered with 5% Modifier | Whole-Liquid Product |
|---|---|---|
| API | 12.2 | 16.7 |
| Density, g/ml | 0.985 | 0.955 |
| S, wt % | 1.15 | 0.31 |
| N, ppm | 4600 | 3181 |
| MCR, wt % | 12.66 | 6.77 |
| Asphaltenes, wt % | 6.62 | 1.42 |
| C, wt % | 87.73 | 87.86 |
| H, wt % | 10.69 | 11.46 |
| H/C, wt/wt | 0.122 | 0.130 |
| V, ppm | 12.5 | UDL |
| Ni, ppm | 11.8 | 2.8 |
| 1000° F.+ (538° C.+) | 51.3 | 41.6 |
| 800° F.+ (427° C.+) | 81.3 | 73.9 |
| 680° F.+ (360° C.+) | 93.7 | 85.4 |

TABLE 8

Effect of UCO hydrotreating on the upgrading of vacuum residuum

| Example 25 | Performance without UCO hydrotreating | Performance with UCO hydrotreating |
|---|---|---|
| | Conversion | |
| S | 80% | 90% |
| N | 41% | 57% |
| MCR | 67% | 86% |
| Asphaltene | 72% | 98% |
| V | 96% | 100% |
| Ni | 86% | 98% |
| | Yield | |
| C1 | 0.8% | 1.0% |
| C2-C4 | 2.3% | 2.7% |
| C5-320° F. | 4.5% | 4.9% |
| 320-482° F. | 7.3% | 8.8% |
| 482-900° F. | 38.1% | 47.7% |
| 900-1004° F | 16.7% | 11.7% |

TABLE 8-continued

| Effect of UCO hydrotreating on the upgrading of vacuum residuum | | |
|---|---|---|
| Example 25 | Performance without UCO hydrotreating | Performance with UCO hydrotreating |
| 1004° F.+ | 27.9% | 21.0% |
| C2-900° F. | 52.2% | 64.0% |
| $H_2S$, $NH_3$, etc. | 3.7% | 4.3% |
| API Uplift | 12.9 | 15.3 |

Examples 26: Valorization of LSFO Product

Example 26 illustrates how blending 80% of modified, filtered, hydrotreated unconverted residuum (680° F.+fraction) blended with 20% light cycle oil (LCO) meets the regulatory specifications of a residuum fuel oil grade RMG380 for marine fuel oil and of IMO 2020 LSFO (low sulfur fuel oil with <0.5 wt % S).

TABLE 9

| Blending with Diluent Cutter stock to Attain RMG380 Specifications | | |
|---|---|---|
| Example 26 | Specification Fuel Oil Grade RMG380 | Blend of 680° F.+ Product with 20% LCO |
| API | 11.3 | 12.4 |
| Density, g/cc | 0.991 | 0.983 |
| Viscosity @ 50° C., cSt | ≤380.0 | 267.8 |
| CCAI (Calc. Carbon Aromaticity Index) | <870 | 848 |
| CII (Calculated Ignition Index) | >30 | 36 |
| N, ppm | / | 4000 |
| S, wt % | ≤0.5 (IMO 2020) | 0.44 |
| MCR, wt % | ≤18.00 | 10.70 |
| C, wt % | / | 88.87 |
| H, wt % | / | 10.75 |
| H/C, wt/wt | / | 0.121 |
| Al + Si, ppm | ≤60 | UDL |
| Na, ppm | ≤100 | UDL |
| Ni, ppm | / | 5.9 |
| V, ppm | ≤350 | UDL |
| Aged Sediment (per ISO 07-2 or ASTM D-4870-09), ppm | ≤1000 | 553 |
| Pour point, ° C. | ≤30 | 6 |
| D664 Acid Number, mg-KOH/g | <2.5 | <0.05 |

Additional detailed description and information related to this invention is provided in the publications and patents identified herein. Each of these publications and patents is incorporated herein by reference in its entirety. The claims provided in this application further describe the scope of the invention, as well as specific embodiments within the scope of the invention. Where any dependent claim refers to one or more previous claims, it is to be understood that all such combinations of claimed features are within the scope of the invention, regardless of whether or not a specific combination of features is explicitly stated.

The foregoing description of the invention, including any specific embodiment(s) of the invention and incorporated publication information, is primarily for illustrative purposes, it being recognized that variations might be used which would still incorporate the essence of the invention. Reference should be made to the following claims in determining the scope of the invention.

What is claimed is:

1. A process for upgrading unconverted heavy oil, the process consisting of:

providing an unconverted heavy oil feed from an ebullated bed hydrocracker, wherein the unconverted heavy oil feed comprises hydrocracker resid;

adding a first aromatics feed to the unconverted heavy oil feed to form a mixture;

passing the mixture directly to a filtration separation process to remove insolubles, thereby forming an unconverted heavy oil stream;

combining a second aromatics feed with the unconverted heavy oil stream to form a second mixture;

passing the second mixture directly to a heavy oil hydrotreating process, thereby forming a hydrotreated heavy oil stream from the second mixture;

wherein the first and the second aromatics feeds comprise an aromatics content of greater than about 20 vol. % aromatics;

the second mixture passed to the heavy oil hydrotreating process has an API in the range of −5 to 15, a sulfur content in the range of 0.7 to 3.5 wt. %, a microcarbon residue content of 8 to 35 wt. %, and a total content of Ni and V of less than 150 ppm;

the hydrotreated heavy oil stream from the hydrotreating process has an API in the range of 2 to 18, a sulfur content in the range of 0.05 to 0.70 wt. %, a microcarbon residue content of 3 to 18 wt. %, and a total content of Ni and V of less than 30 ppm; and wherein the process does not include a maturation step, does not include an aging step, and does not include a sedimentation step other than the filtration.

2. The process of claim 1, wherein the unconverted heavy oil has been subjected to hydrocracking and demetallation in the ebullated bed hydrocracker.

3. The process of claim 1, wherein the process provides a product for use in a low sulfur fuel oil having a sulfur content of less than 0.5 wt. %.

4. The process of claim 1, wherein the unconverted heavy oil feed comprises a bottoms product from the ebullated bed hydrocracker.

5. The process of claim 1, wherein the unconverted heavy oil feed is obtained from atmospheric residuum, vacuum residuum, tar from a solvent deasphalting unit, atmospheric gas oil, vacuum gas oil, deasphalted oil, oil derived from tar sands or bitumen, oil derived from coal, heavy crude oil, oil derived from recycled oil wastes and polymers, or a combination thereof.

6. The process of claim 1, wherein the separation filtration process comprises filtration selected from mesh, screen, cross-flow filtration, backwash filtration, or a combination thereof.

7. The process of claim 6, wherein the filtration comprises a filtration membrane having an average pore size of less than 10 microns.

8. The process of claim 7, wherein the filtration membrane is composed of a material selected from metals, polymeric materials, ceramics, glasses, nanomaterials, or a combination thereof.

9. The process of claim 7, wherein the filtration membrane is composed of a metal selected from stainless steel, titanium, bronze, aluminum, nickel, copper and alloys thereof.

10. The process of claim 7, wherein the membrane is further coated with an inorganic metal oxide coating.

11. The process of claim 1, wherein the first aromatics feed and the second aromatics feed is are selected from light cycle oil, medium cycle oil, heavy cycle oil, slurry oil, vacuum gas oil, or a mixture thereof.

12. The process of claim 1, wherein the heavy oil hydrotreating process comprises a catalyst selected from a demetallation catalyst, a desulfurization catalyst, or a combination thereof.

13. The process of claim 1, wherein the heavy oil hydrotreating process comprises a catalyst composition comprising about 5-20 vol. % of a grading and demetallation catalyst, about 10-30 vol. % of a transition-conversion catalyst, and about 50-80 vol. % of a deep conversion catalyst.

14. A process for making a low sulfur fuel oil from unconverted heavy oil, the process comprising upgrading an unconverted heavy oil according to the process of claim 1; passing the hydrotreated heavy oil stream to a fractionator; and, recovering a low sulfur fuel oil product.

15. A low sulfur fuel oil made from a process according to claim 1.

* * * * *